US005258112A

United States Patent [19]

Wild et al.

[11] Patent Number: 5,258,112

[45] Date of Patent: Nov. 2, 1993

[54] ELECTROLYTE COMPOSITIONS

[75] Inventors: Malcolm Wild, Nr. Huddersfield; David Crosby, Eggborough, both of England

[73] Assignee: Yorkshire Chemicals PLC., Leeds, England

[21] Appl. No.: 803,060

[22] Filed: Dec. 6, 1991

[30] Foreign Application Priority Data

Dec. 8, 1990 [GB] United Kingdom ..... 9026747

[51] Int. Cl.[5] ..... C25D 3/32

[52] U.S. Cl. ..... 205/302; 205/303; 106/1.25

[58] Field of Search ..... 205/300, 302, 303; 106/1.25

[56] References Cited

U.S. PATENT DOCUMENTS 4,582,576 4/1986 Opaskar et al. ..... 204/44.4
4,885,064 12/1989 Bokisa et al. ..... 205/302
4,936,965 6/1990 Ooniwa et al. ..... 205/302
4,994,155 2/1991 Toben et al. ..... 205/302

FOREIGN PATENT DOCUMENTS 874764 10/1981 U.S.S.R. ..... 205/300

OTHER PUBLICATIONS

Journal of the Electrochemical Society, vol. 102, No. 7, Jul. 1955, pp. 387-389 C. A. Discher et al.: "Brightening Agents for the Tin-II Sulfate-Sulfuric Acid Electrolyte".

*Primary Examiner*—John Niebling
*Assistant Examiner*—Brian M. Bolam
*Attorney, Agent, or Firm*—Varndell Legal Group

[57] ABSTRACT

A composition suitable for use in a process for electroplating surfaces with tin, including an alkane sulphonic acid optionally together with an aryl sulphonic acid; a tin source; and an additive, such as a reaction product of a sulphonating agent with Bisphenol A.

22 Claims, No Drawings

ELECTROLYTE COMPOSITIONS

This invention relates to electrolyte compositions suitable for electroplating surfaces with tin and to methods of electroplating surfaces with tin.

Many electrolyte compositions have been made known and are available in the art. Typical baths include aqueous acidic baths based upon fluoborate or fluosilicate electrolytes and these are described, for example, in U.S. Pat. Nos. 3,769,182 and 4,118,289. Aryl sulphonic acids have been used in electroplating baths as disclosed, for example, in U.S. Pat. Nos. 3,905,878 and 4,130,610. Traditionally, the aryl sulphonic acid of choice is phenol sulphonic acid as used in the Ferrostan process.

Alkane sulphonic acids containing 1 to 5 carbon atoms in the alkyl group having previously been used in certain electrolytic plating baths and were first disclosed for this use in U.S. Pat. No. 2,522,942.

More recently, methane sulphonic acid has been claimed as a specific preferred example of an alkane sulphonic acid in combination with a number of brightening agents for use in the electroplating of tin, lead and tin-lead alloys. Various plating bath compositions comprising an alkane or alkanol sulphonic acid (normally methane sulphonic acid), a tin and/or a lead salt and various auxiliary additives are known. Known auxiliary additives range from smaller organic molecules to large polymeric surfactant molecules and are described in U.S. Pat. Nos. 4,555,314, 4,565,609, 4,582,576, 4,599,149, 4,617,097, 4,662,999, 4,673,470, 4,701,244, 4,828,657 and U.S. Pat. No. 4,849,059.

According to one aspect of the present invention, there is provided a composition suitable for use in a process for electroplating surfaces with tin, which comprises:

a) an alkane sulphonic acid,
b) an aryl sulphonic acid,
c) an additive, and
d) a tin source.

Preferably, the composition is an aqueous solution and the tin source is a tin salt.

Alternatively the tin source may be elemental tin.

The alkane sulphonic acid usually has the formula:

$$RSO_3H$$

wherein R is an alkyl group preferably containing from 1 to 10 carbon atoms, and more preferably containing from 1 to 4 carbon atoms. R may be substituted. Suitable substituents include methyl, ethyl, propyl, hydrcxypropyl (e.g. 1-hydroxypropyl), n-butyl, sec.-butyl, hexyl and decyl. Examples of suitable alkane sulphonic acids include: methane sulphonic acid, ethane sulphonic acid, propane sulphonic acid, 2-propane sulphonic acid, 1-hydroxypropane 2-sulphonic acid, butane sulphonic acid, 2-butane sulphonic acid, hexane sulphonic acid and decane sulphonic acid.

The aryl sulphonic acid usually has the formula:

$$ArSO_3H$$

wherein Ar is an aromatic group which preferably contains up to 20 carbon atoms, more preferably from 6 to 12 carbon atoms the aromatic group may be substituted by e.g. hydroxy, alkyl or alkoxy substituents. If an alkyl or an alkoxy substituent is present it preferably contains from 1 to 5 carbon atoms. Examples of suitable aryl sulphonic acids include benzene sulphonic acid; naphthalene sulphonic acids (e.g. naphthalene 2-sulphonic acid and naphthalene 1-sulphonic acid); phenol mono or disulphonic acids (e.g. 2-phenolsulphonic acid, 4-phenolsulphonic acid, 2,4-phenoldisulphonic and 2,6-phenoldisulphonic acid); cresol sulphonic acids (e.g. 2-3-, or 4-cresol-sulphonic acids).

The acids (i.e. aryl plus alkane sulphonic acids) are preferably present at a total concentration of 25–500 g/l of the composition (with respect to the composition).

The preferred weight/weight ratio of alkane sulphonic acid:aryl sulphonic acid is from 10:90 to 90:10. More preferably this ratio is from 30:70 to 70:30, still more preferably this ratio is from 40:60 to 70:30.

The tin source is preferably present in the composition of the present invention at a concentration of 1–100 g/l with respect to the composition. Where a tin salt is the tin source, it does not have to be a salt of the alkane or aryl sulphonic acid, for example it can be tin (II) sulphate. Thus the composition may contain ions other than tin and sulphonate.

The composition of this aspect of the present invention demonstrates a synergistic effect with respect to compositions which have only an alkane sulphonic acid or only an aryl sulphonic acid as a sulphonic acid component. The composition of the present invention when used for tin-plating provides a wider plating range than can be obtained for tin-plating using compositions comprising either an aryl or an alkane sulphonic acid alone.

Accordingly, within the scope of the present invention is a method of tin-plating a surface, comprising electro-depositing tin from a composition as hereinbefore described onto the surface.

Where the tin source is solid tin, it may be used as a tin anode which gradually dissolves as electrolysis proceeds to maintain a substantially constant concentration of tin ions in an electroplating bath.

Where the tin source is a tin salt it may be metered to the electroplating bath so that as tin is electrodeposited from the bath, tin salt is added to the bath to maintain the concentration of tin ions in the bath at a constant level.

Preferably the alkane sulphonic acid is methane sulphonic acid (MSA) and the aryl sulphonic acid is a phenol sulphonic acid (PSA). This combination surprisingly can be used for tin-plating without the need for extensive enclosure/extraction systems, which are generally considered necessary when MSA is used as the sole sulphonic acid component, since MSA has a pungent odour and can be toxic to humans.

The composition of the present invention also comprises one or more additives suitable for enhancing the quality of tin-plate produced by the method of the present invention. Such additives are preferably present at a concentration of 1–25 g/l with respect to the total composition of the present invention. They can include, condensates of hydrophobic organic compounds with alkylene oxides such as, for example, α-naphthol 6 mole ethoxylate(ENSA-6, as supplied by Emery-Trylon); derivatives of N-heterocycles such as, for example, 2-alkylimidazolines; aromatic aldehydes such as, for example naphthaldehyde; substituted acetones such as, for example, benzylidene acetone; alcohols; phenols; and derivatives of acetic acid. Preferred additives are those derivatives of Bisphenol A described in GB-A-1,146,588. These derivatives are prepared by the reaction of a sulphonating agent with a compound of general formula:

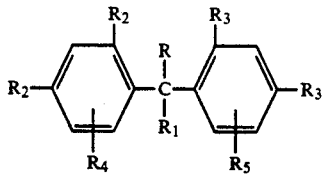

wherein:

R and $R_1$ each represent hydrogen or an alkyl group having from 1 to 4 carbon atoms, $R_2$ and $R_3$ each represent hydrogen, an alkyl group having from 1 to 4 carbon atoms or a hydroxyl radical, and in which one of the $R_2$ radicals and one of the $R_3$ radicals is a hydroxyl radical, $R_4$ is hydrogen when one $R_2$ is an alkyl radical and is hydrogen or an alkyl group having from 1 to 4 carbon atoms when one $R_2$ radical is hydrogen, $R_5$ is hydrogen when one $R_3$ is an alkyl radical and is hydrogen or an alkyl radical having from 1 to 4 carbon atoms when one of the $R_3$ radicals is hydrogen.

The most preferred of these derivatives is the reaction product of a sulphonating agent with 2,2-[bis(4-hydroxyphenyl)]propane, which is obtainable from Yorkshire Chemicals plc, Leeds, England under the trade mark of "Diphone V".

The additives can be used e.g. to give improved solderability, improved matte or lustre of finish and to substantially prevent the formation of wood-grain or chevron effects in the tin-plate product.

The additive may be anionic, cationic, amphoteric or non-ionic. Desirably, it is sufficiently stable so that it can still perform its function in the tin-plating process after it has undergone 15 ampere hours of electrolysis as part of a composition of the present invention.

Stability of the additive can also be tested by heating a 1% w/v solution of the additive (with respect to a basis solution of a composition of the present invention consisting of an alkane sulphonic acid, an aryl sulphonic acid, at least one solution soluble tin compound and the additive) to 32.2° C. (90° F.) and determining if the solution turns cloudy to the naked eye. Preferred additives for use in the present invention do not turn cloudy to the naked eye when tested in this manner.

Desirably, the composition of the present invention has a pH of from 0 to 3; more preferably from 0 to 2. Those skilled in the art will be able to prepare compositions within this pH range by e.g. selecting suitable sulphonic acids and/or by adding a different acid and/or an alkali, as required.

The present invention can be used to provide improved tin/sulphonic acid baths with good throwing power, improved surface finish capability and broad current density ranges.

A preferred method of the present invention comprises adding an alkyl sulphonic acid as hereinbefore described to a tin-plating bath containing one or more aryl sulphonic acids as the sulphonic acid component and then electroplating tin from the bath onto a surface.

Conversely, an aryl sulphonic acid as hereinbefore described can be added to a tin-plating bath containing only one or more alkane sulphonic acids as a sulphonic acid component and then tin can be electroplated from the bath onto a surface.

These methods are convenient in that they can be performed using the apparatus and compositions of known tin-plating processes and therefore these processes do not require extensive modification to achieve the beneficial results of the present invention.

Although the present invention has been particularly described above with respect to mixtures of aryl and alkyl sulphonic acids, it has surprisingly been found that it is not necessary to use such mixtures to achieve good tin-plating results if an alkane (e.g. methane) sulphonic acid is used with a particular type of additive.

Accordingly, another aspect of the present invention is a composition suitable for use in a process for electroplating surfaces with tin which comprises:

a) an alkane sulphonic acid, b) a tin source, and c) a reaction product of a sulphonating agent with Bisphenol A.

The alkane sulphonic acid, tin salt and Bisphenol A derivative are all as hereinbefore described. They are preferably present at concentrations of 25–500 g/l, 1–100 g/l and 1–25 g/l respectively (with respect to the composition).

This composition can be used in a method of tin-plating a surface as hereinbefore described, comprising electro-depositing tin from the composition onto the surface.

The present invention will now be described by way of example for the purposes of illustration only.

EXAMPLES

The electroplating characteristics of various compositions were determined in a Hull Cell operated at 3 amps total current for 1 minute at 50° C.

The ranges of the components used in the Examples are those preferred for commercial practice and are:

Tin (as sulphonic acid salt): 5 to 100 g/l

Total alkane sulphonic acid: 5 to 250 g/l

Total aryl sulphonic acid: 5 to 250 g/l

Additive: 1 to 25 g/l (for each different additive used).

The compositions used were as set out in Tables 1 and 4 below, but with the inclusion of an additive as indicated in Tables 2 and 5, respectively.

In Tables 1, 2, 4 and 5 the FIGURES in g/l are with respect to the total composition used (i.e. an aqueous composition comprising tin (as a sulphonic acid salt) methane sulphonic acid, phenol-4-sulphonic acid and an additive).

Tables 2 and 5 illustrate the usable range of current density obtainable with the compositions referred to therein.

Table 3 shows the results obtained by varying the ratio of methane sulphonic acid to phenol-4-sulphonic acid in an aqueous composition of the present invention. All of the Examples given in Table 3 used Diphone V as the additive at a level of 4 g/l with respect to the composition. Table 5 shows the results obtained by varying the ratio of phenol-4-sulphonic acid to 3-hydroxypropane-1-sulphonic acid in an aqueous composition of the present invention.

All of the Examples given in Table 6 used Diphone V as the additive at a level of 6 g/l with respect to the composition. Tin (as a sulphonic acid salt) was present at 20 g/l with respect to the composition. It can be seen that a synergistic effect with respect to the tin-plating range is obtained in using mixtures of the aryl and alkane sulphonic acids rather than using an alkane sulphonic acid alone or an aryl sulphonic acid alone as the sulphonic acid component.

TABLE 1

| | | A | B | C | D | E | F |
|---|---|---|---|---|---|---|---|
| Tin (as sulphonic acid salt) | g/l | 20 | 20 | 20 | 20 | 55 | 55 |
| Methane sulphonic acid | g/l | 1 | 34 | 83 | 165 | 34 | 83 |
| Phenol-4-sulphonic acid | g/l | 165 | 132 | 83 | 1 | 132 | 83 |

TABLE 2

| Example number | Basis solution | Additive type | Amount of additive g/l | Observed in plating range in amps/m$^2$ (amps/ft$^2$) |
|---|---|---|---|---|
| 1 | 1A | Diphone V | 4 | 829-2583 (77-240) |
| 2 | 1B | Diphone V | 4 | 592-2583 (55-240) |
| 3 | 1C | Diphone V | 4 | 108-2691 (10-250) |
| 4 | 1D | Diphone V | 4 | 226-1938 (21-180) |
| 5 | 1E | Diphone V | 4 | 1130-3767 (105-350) |
| 6 | 1F | Diphone V | 4 | 377-3767 (35-350) |
| 7 | 1C | Benzylidene acetone | 4 | 484-2476 (45-230) |
| 8 | 1C | ENSA-6 | 4 | 861-2368 (80-220) |
| 9 | 1C | Acetaldehyde | 2 | 861-2961 (80-275) |
| 10 | 1C | Nonyl phenol and 12 mole ethoxylate | 10 | 969-2260 (90-210) |

TABLE 3

| Example range number | Ratio of methane sulphonic acid: phenol-4-sulphonic acid (wt/wt ratio) | Observed plating amps/m$^2$ (amps/ft$^2$) |
|---|---|---|
| 11 | 0:100 | 829-2583 (77-240) |
| 12 | 10:90 | 732-2483 (68-240) |
| 13 | 20:80 | 592-2583 (55-240) |
| 14 | 30:70 | 592-2691 (55-250) |
| 15 | 40:60 | 355-2583 (33-240) |
| 16 | 50:50 | 108-2691 (10-250) |
| 17 | 60:40 | 108-2691 (10-250) |
| 18 | 70:30 | 108-2476 (10-230) |
| 19 | 80:20 | 226-1938 (21-180) |
| 20 | 90:10 | 484-2260 (45-210) |
| 21 | 100:0 | 700-2691 (65-250) |

TABLE 4

| | | A | B | C | D | E | F | G | H |
|---|---|---|---|---|---|---|---|---|---|
| Tin (as sulphonic acid salt) | g/l | 20 | 20 | 20 | 20 | 20 | 20 | 20 | 20 |
| 3-Hydroxypropane-1-sulphonic acid | g/l | 1 | 33 | 50 | 66 | 83 | 100 | 116 | 165 |
| Phenol-4-sulphonic acid | g/l | 165 | 133 | 116 | 100 | 83 | 66 | 50 | 1 |

TABLE 5

| Example number | Basis solution | Additive type | Amount of additive g/l | Observed in plating range in amps/m$^2$ (amps/ft$^2$) |
|---|---|---|---|---|
| 22 | 4A | Diphone V | 4 | 829-2583 (77-240) |
| 23 | 4B | Diphone V | 4 | 678-2691 (63-250) |
| 24 | 4C | Diphone V | 4 | 108-2476 (10-230) |
| 25 | 4D | Diphone V | 4 | 151-2583 (14-240) |
| 26 | 4E | Diphone V | 4 | 108-2583 (10-240) |
| 27 | 4F | Diphone V | 4 | 108-2583 (10-240) |
| 28 | 4G | Diphone V | 4 | 108-1722 (10-160) |
| 29 | 4H | Diphone V | 4 | 108-1938 (10-180) |

TABLE 6

Freshly prepared electrolyte, Diphone V 6 g/l, Test temp 50° C.

| Example number | Ratio of PSA:MSA (unit/wt ratio) PSA:MSA | | Observed Plating amps/m$^2$ (amps/ft$^2$) |
|---|---|---|---|
| 30 | 100 | 0 | 861-4252 (80-395) |
| 31 | 75 | 25 | 861-4629 (80-430) |
| 32 | 50 | 50 | 861-4737 (80-440) |
| 33 | 25 | 75 | 861-4737 (80-440) |
| 34 | 0 | 100 | 1077-5329 (100-495) |

We claim:

1. A composition suitable for use in a process for electroplating surfaces with tin, which comprises
   (a) an alkane sulphonic acid in an amount of 5 to 250 g/l based on the composition,
   (b) an aryl sulphonic acid in an amount of 5 to 250g/l in the composition,
   (c) an additive in an amount of 1 to 25 g/l based on the composition, and
   (d) a tin source in an amount of 5 to 100 g/l based on the composition,
   wherein the weight:weight ratio of alkane sulfonic acid to aryl sulfonic acid is from 20:80 to 80:20.

2. A composition according to claim 1, wherein the alkane sulphonic acid has the formula $$RSO_3H$$

wherein R is an unsubstituted or substituted alkyl group containing from 1 to 10 carbon atoms.

3. A composition according to claim 1, wherein the alkane sulphonic acid is methane sulphonic acid.

4. A composition according to claim 1, wherein the aryl sulphonic acid has the formula $$ArSO_3H$$

wherein Ar is an unsubstituted or a substituted aromatic group containing up to 20 carbon atoms.

5. A composition according to claim 1, wherein the aryl sulphonic acid is a phenol sulphonic acid.

6. A composition according to claim 1, wherein the weight/weight ratio of alkane sulphonic acid:aryl sulphonic acid is from 25:75 to 75:25.

7. A composition according to claim 1, wherein the weight/weight ratio of alkane sulphonic acid:aryl sulphonic acid is from 30:70 to 70:30.

8. A composition according to claim 1, wherein the weight/weight ratio of alkane sulphonic acid:aryl sulphonic acid is from 40:60 to 60:40.

9. A composition according to claim 1, wherein the additive is selected from the group consisting of condensates of hydrophobic organic compounds with alkylene oxides, derivatives of N-heterocycles, aromatic aldehydes, substituted acetones, alcohols, phenols, and derivatives of acetic acid.

10. A composition according claim 1, wherein the additive is a derivative of Bisphenol A.

11. A composition according to claim 1, wherein the additive is the reaction product of a sulphonating agent with 2,2-[bis(4-hydroxyphenyl)] propane.

12. A method of tin-plating a surface, which comprises electro-depositing tin from a composition which comprises
   (a) an alkane sulphonic acid in an amount of 5 to 250 g/l based on the composition, (b) an aryl sulphonic acid in an amount of 5 to 250 g/l in the composition, (c) an additive in an amount of 1 to 25 g/l based on the composition, and (d) a tin source in an amount of 5 to 100 g/l based on the composition, wherein the weight ratio of alkane sulfonic acid to aryl sulfonic acid is from 20:80 to 80:20.

13. A method according to claim 12, wherein the tin source is elemental tin which is used as a tin anode which gradually dissolves as electrolysis proceeds to maintain a substantially constant concentration of tin ions in an electroplating bath.

14. A method according to claim 12, wherein the tin source is a tin salt which is metered to an electroplating bath so that as tin is electrodeposited from the bath, tin salt is added to the bath to maintain the concentration of tin ions in the bath at a constant level.

15. A method according to claim 12, wherein the alkyl sulphonic acid is added to a tin-plating bath containing the aryl sulphonic acid or the aryl sulphonic acid is added to a tin-plating bath containing the alkyl sulphonic acid, and tin is electroplated from the bath on to a surface.

16. A composition suitable for use in a process for electroplating surfaces with tin, which comprises (a) an alkane sulphonic acid in an amount of 25–500 g/l based on the composition, (b) a tin source in an amount of 1–100 g/l based on the composition, and (c) a reaction product of a sulphonating agent with Bisphenol A in an amount of 1–25 g/l based on the composition.

17. A composition according to claim 16, wherein the alkane sulphonic acid has the formula $$RSO_3H$$

wherein R is an unsubstituted alkyl group containing from 1 to 10 carbon atoms.

18. A composition according to claim 16, wherein the alkane sulphonic acid is methane sulphonic acid.

19. A composition according to claim 16, wherein the derivative of Bisphenol A is the reaction product of a sulphonating agent with 2,2-[bis(4-hydroxyphenyl)] propane.

20. A method of tin-plating a surface, which comprises electro-depositing tin from a composition which comprises (a) an alkane sulphonic acid in an amount of 25–500 g/l based on the composition, (b) a tin source in an amount of 1–100 g/l based on the composition, and (c) a reaction product of a sulphonating agent with Bisphenol A in an amount of 1–25 g/l based on the composition.

21. A method according to claim 20, wherein the tin source is elemental tin which is used as a tin anode which gradually dissolves as electrolysis proceeds to maintain a substantially constant concentration of tin ions in an electroplating bath.

22. A method according to claim 20, wherein the tin source is a tin salt which is metered to an electroplating bath so that as tin is electrodeposited from the bath, tin salt is added to the bath to maintain the concentration of tin ions in the bath at a constant level.

* * * * *